United States Patent [19]

Barbour

[11] 4,037,534

[45] July 26, 1977

[54] IMPRINTER

[76] Inventor: William P. Barbour, 791 E. Fairview Ave., Annapolis, Md. 21403

[21] Appl. No.: 626,999

[22] Filed: Oct. 29, 1975

[51] Int. Cl.[2] ..... B41F 3/04

[52] U.S. Cl. ..... 101/269

[58] Field of Search ..... 101/45, 56, 269–274

[56] References Cited

U.S. PATENT DOCUMENTS

| | | | |
|---|---|---|---|
| 3,018,725 | 1/1962 | Maul et al. | 101/269 |
| 3,283,711 | 11/1966 | Lew | 101/269 |
| 3,596,596 | 8/1971 | Chillingworth | 101/269 |
| 3,602,139 | 8/1971 | Allport | 101/269 |

*Primary Examiner*—Edward M. Coven

*Attorney, Agent, or Firm*—Craig & Antonelli

[57] ABSTRACT

An imprinter with a lifting system for lowering the platen roller during the imprint stroke and raising the platen roller during the return stroke. The lifting system includes a lift cam lever and lifting cam associated with the front wheel and kept under constant bias. The lifting cam lever engages in slots arranged along a track of the imprinter bed, and the front axle is eccentrically mounted in the lifting cam such that when a carriage assembly having a platen roller is moved through the imprint stroke the platen roller applies pressure, and as the carriage assembly is ready to be returned, the lifting cam lever will be in registration with a slot on the track such that upon the return stroke the lifting cam lever will lift the carriage assembly.

6 Claims, 5 Drawing Figures

IMPRINTER

BACKGROUND AND SUMMARY OF THE INVENTION

The present invention relates to an imprinter with a movable carriage having a platen roller, and, more particularly, to a lifting system for lowering the platen roller during the imprinting stroke and raising the platen roller during the return stroke.

In the past, it has been conventional practice to provide an imprinter having a platen roller which forms print impressions on one or more sheets by rolling the platen over the sheets with some pressure to engage the face of a printing plate such as a plastic credit card. During the return stroke, it is desirable to lift the platen slightly so that the imprinting operation will not take place during the return stroke. To achieve this, however, it has been necessary to provide a mechanism in the carriage itself in association with the platen assembly to form a lifting system. However, such a mechanism unduly complicates the carriage assembly and makes the cost of the imprinter that much more expensive. Furthermore, the possibility of raising and lowering a multiplicity of platen rollers becomes complicated and expensive when the lifting and lowering action is associated directly with the platen rollers.

It is an object of the present invention to overcome these problems by providing a relatively simple lifting system or mechanism which acts to lift or lower the entire carriage assembly.

It is a further object of the present invention to provide a lifting mechanism which is relatively simple in construction and therefore is relatively trouble-free.

It is a still further object of the present invention to provide a lifting mechanism which is simple in construction and which is relatively easy to construct so that the manufacturing costs for such an imprinter are reduced.

The foregoing has been achieved in accordance with the present invention by providing a platen lifting system which includes a lift cam lever and lifting cam associated with the front wheel whereby the lifting cam lever is kept under constant bias by a spring connected with an axle on the rear wheel. The lifting cam lever is adapted to engage in slots arranged along a track on the imprinter bed. The front shaft is eccentrically mounted in the lifting cam so that when the carriage is moved through the imprinting stroke the platen roller applies pressure in the area of the bed plate and as it is ready to be returned the lifting cam lever will be in registration with a slot on the track and be biased into the slot by the spring connected between the rear wheel axle and the lifting cam lever. As a result, upon return of the carriage the lifting cam lever will lift the entire carriage including the platen roller at least about sixty thousandths of an inch due to the eccentrically mounted front axle.

BRIEF DESCRIPTION OF THE DRAWINGS

These and further features, objects and advantages of the present invention will become apparent from the following description when taken in conjunction with the accompanying drawings which show, for purposes of illustration only, a preferred embodiment of the present invention and wherein.

DETAILED DESCRIPTION OF A PREFERRED EMBODIMENT

Figure 2:
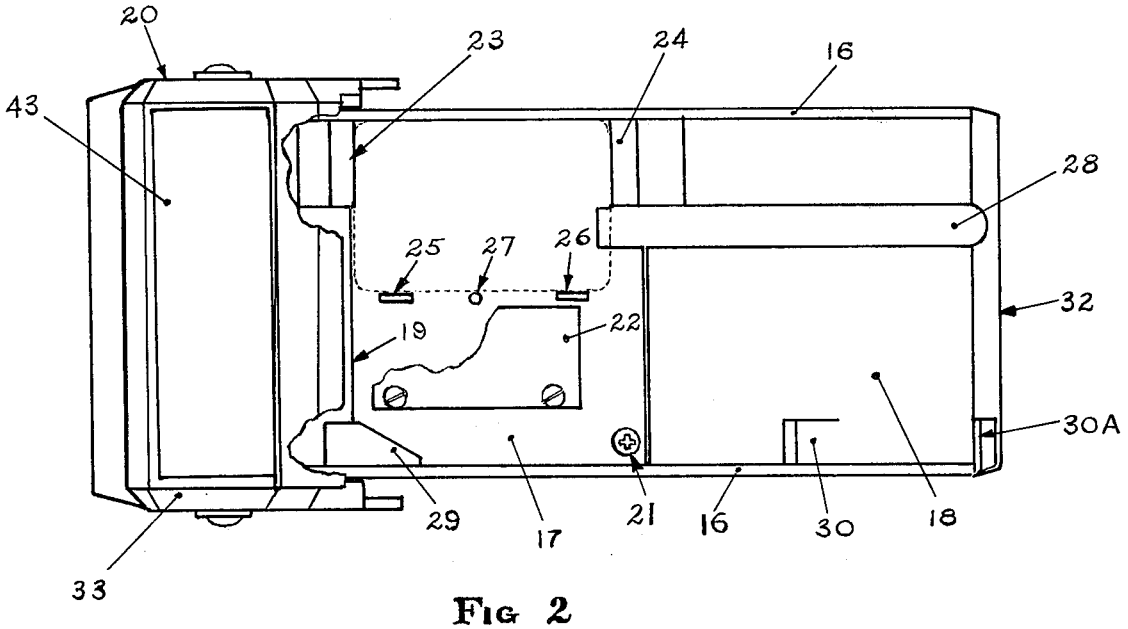
FIG. 2 is a plan view of the imprinter shown in FIG. 1.
Figure 1:
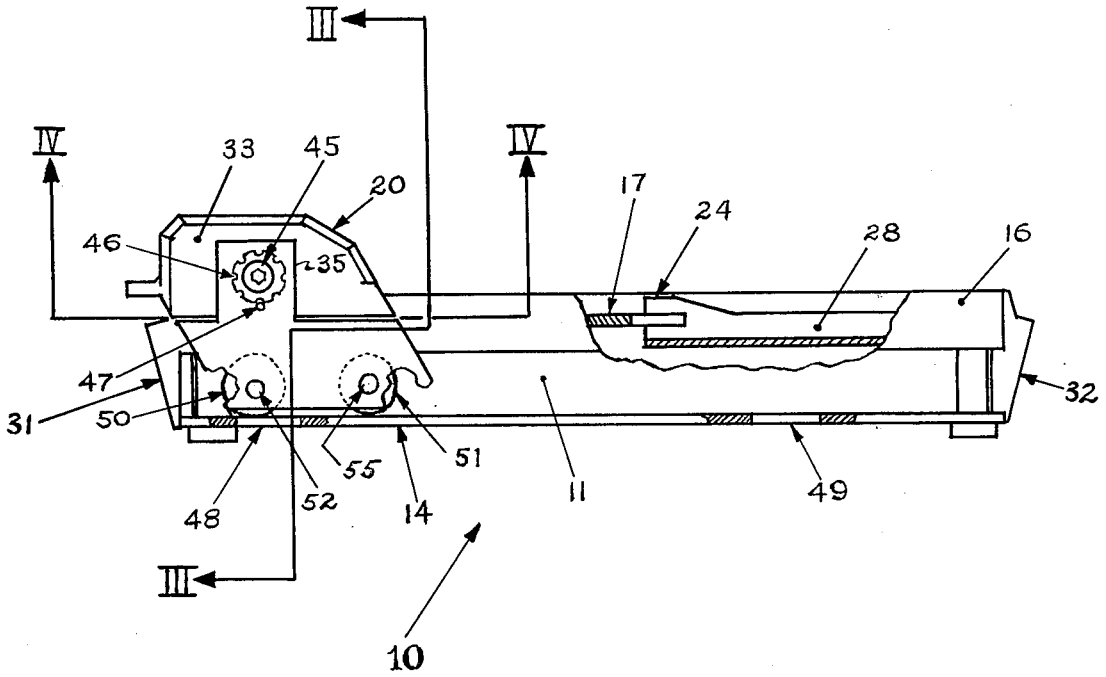
FIG. 1 is a side elevational view of a manually operated imprinter according to the present invention.
Figure 3:
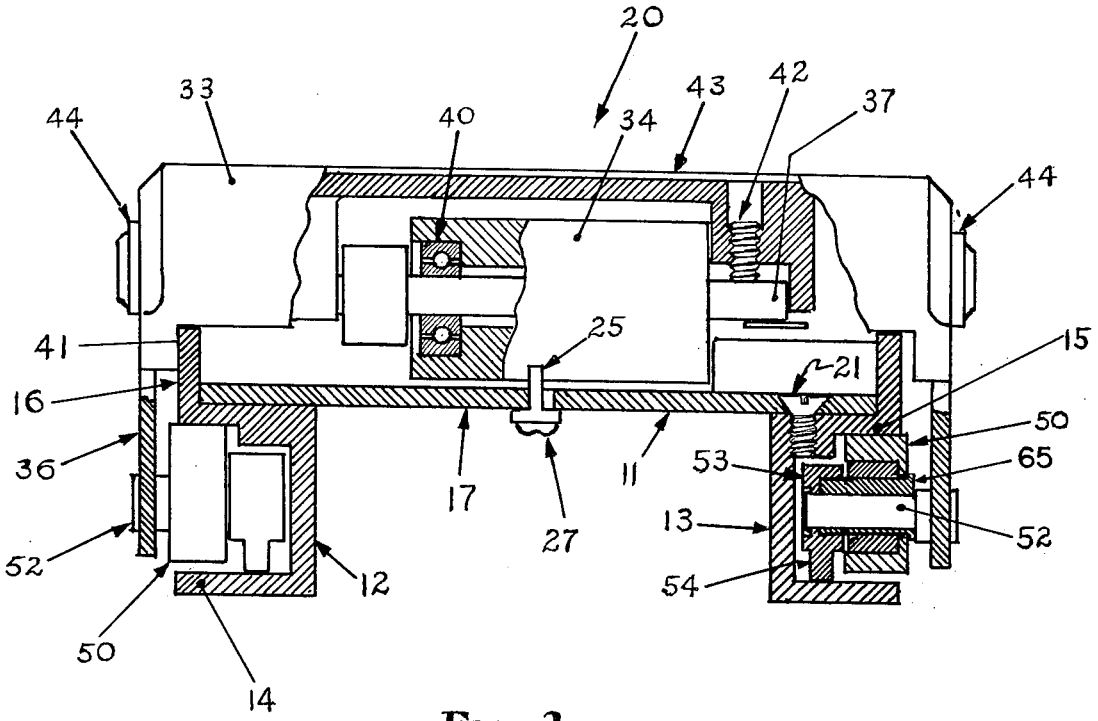
FIG. 3 is a partial sectional view of the imprinter in the area of the carriage and rear roller assembly as viewed in the direction of line III—III in FIG. 1.

Referring now to the drawings and, in particular, to FIG. 1, a manually operated imprinter is designated generally by the numeral 10. The imprinter comprises a base 11 consisting essentially of two channel members 12, 13 as shown in FIG. 3, which can be formed of an extruded light metal so as to reduce the manufacturing cost as well as the weight of the imprinter. Each of the channels has a lower track 14 and an upper track 15 from which an integral vertical side wall 16 extends as a guide for the carriage assembly designated generally by the numeral 20 and to be described below in greater detail. Since both tracks 12, 13 can be made from the same extruded piece of plastic or metal, the same numerals have been used to designate the upper and lower tracks as well as the side wall thereof. On the upper surface of the upper track 15 on each of the channels 12 and 13 are mounted a bed plate 17 which is the area in which the printing operation is done and therefore is constructed of metal or sturdy plastic, a second plate 18, and a third plate 19 (FIG. 2) over which the carriage assembly 20 is located in its starting position. These plates are secured to the upper surface of the channels 12, 13 by conventional securing means such as screws 21 or the like.

The bed plate 17 carries a "dealer" plate fragmentarily shown and designated by the numeral 22 and could also include a conventional "amount" and/or "date" assembly which is not shown. Locating pieces 23, 24 can be provided in a conventional manner as well as flexible card centering stops 25, 26 constructed in one piece and secured to the bed plate 17 by a screw 27 or the like. Since these features are conventional and do not form part of the present invention, a further discussion thereof is unnecessary for an understanding of the present invention. However, it should also be noted that the plate 18 and a peripheral portion of the bed plate 17 are provided with a slot 28 located in the longitudinal direction of the imprinter to allow the user to put his or her finger therein and thereby have ready access to the underside of the printing plate or credit card for easy and quick removal thereof. For the sheets which can include carbon for receiving the imprinter information from the printing plate, locating stops 29, 30 and 30A are also provided on the plates in a conventional manner. To provide a finished appearance, the second plate 18 and the third plate 19 have end pieces 31, 32 extending transversely across the channels and plates and can be constructed of plastic or the like.

Figure 4:
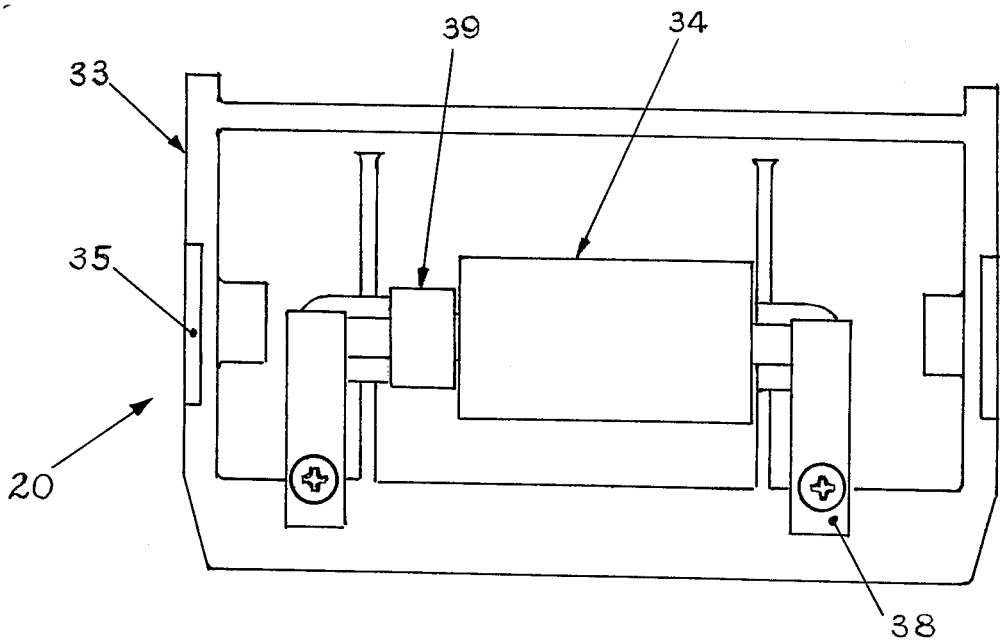
FIG. 4 is a view of the carriage assembly as viewed in the direction of line IV—IV in FIG. 1.

The carriage assembly 20 will now be explained with reference to FIGS. 3 and 4. The carriage assembly 20 essentially consists of a carriage cover 33 which can be fabricated from molded plastic and a platen roller 34 mounted within the cover 33. The vertical end portions of the cover have a slot 35 therein for accommodating a side plate 36 to be discussed in greater detail hereinbelow. An axle 37 for the platen roller 34 is mounted within intergrally molded projections within the carriage cover 33 and is retained therein by flat springs 38 made of spring steel or the like as shown in FIG. 4. Where, as shown, a smaller platen roller 34 is to be utilized for imprinting, a spacer roller 39 can be mounted on the axle 37 to prevent shifting of the platen roller 34. If, however, a larger platen roller is desired for imprinting a greater area of information, the spacer roller 39 and the platen roller 34 can be removed and be replaced by a platen roller of greater axial length. The platen roller 34 is mounted upon suitable bearings 40. The inner surface 41 of the carriage cover 33 cooperates with the outer surfaces of the vertical flanges 16 on the channel members 12, 13. Screws 42 are threadably received in the molded projections in the carriage cover 33 and contact the axle 37 of the platen roller 34 to effect vertical adjustment of the platen roller as desired. Only one such screw is shown in FIG. 3. A space 43 is provided in the top of the carriage cover 33 so that a plate can be inserted therein as a decorative piece to hide the screws 42. Such a plate can also carry manufacturer's information.

For initial or factory adjustment of the carriage cover 34 relatively to the bed plate 17, a disk 44, 44' is mounted on each side of the carriage assembly 20 and is eccentrically mounted about an axle 45. The discs are provided with numbered detents e.g. 46, (FIG. 1) which detents cooperate with an indice 47 located on the side plate 36. By turning the disc 44 to a selected detent and having the detent line up with the indice 47, the carriage cover 33 can be raised or lowered by virtue of the eccentric mounting of the disc 44 and consequently an adjustment effected in which the carriage cover will rest on the top of rail 16 and the wheel 50 be biased upward to rest against the under side of rail 15 to effectively eliminate looseness in the mechanism when it is in its imprinting mode or stroke.

The lifting system in accordance with the present invention will now be described. In each of the lower tracks 14 on the channel members 12, 13 there are provided two axially spaced slots 48, 49 extending through the lower tracks 14. As best seen in FIG. 1, the first slot 48 is located toward the front end of the imprinter 10 whereas the second slot 49 is located toward the rear end of the imprinter and at the beginning of the return stroke of the carriage 20. Associated with each side plate 36 is a front wheel 50 and a rear wheel 51. The wheels are mounted so as to roll against the bottom surface of the upper track 15 of each channel member 13. As most clearly shown in FIG. 3, the front wheel 50 is concentrically mounted on and rotatable about a lifting cam 65 within which is eccentrically mounted a front axle 52 having one end operatively arranged in the side plate 36. The lifting cam can be made of hardened, ground metal, and appropriate needle bearings can be provided between the lifting cam and the roller 50. A lifting cam lever 53 having a projecting portion 54 is press fitted on the end of the lifting cam 51 and held thereon by flaring the end of the front axle 52 thereagainst. Thus, the lifting cam 51 and lifting cam lever 53 act in unison as if they were one integral piece.

It should also be pointed out that the front axle 52 is received within the side plate 36 in such a manner that, as will later be described, as the axle 52 is raised or lowered due to its eccentric mounting the side plate 36 and the carriage cover 33 will be raised or lowered therewith. This also means that the platen roller 34 will also be raised or lowered. The rear wheel 51 is concentrically mounted about an axle 55, and also concentrically mounted about the axle 55 is a collar 56 having a projecting lug 57 with the bore 58 therethrough. A projecting lug 59 with a bore 60 is also integrally attached to the lifting cam 53 associated with the front wheel 50. A tension spring 61 is mounted through each bore 58, 60 so as to bias the projection 54 on the lifting cam lever 53 in the counterclockwise direction as viewed in FIGS. 1 and 5.

The operation of the present invention will now be described with reference to FIGS. 1 and 5. When it is desired to conduct an imprinting operation, the printing plate and the sheets to be imprinted are located at the appropriate places on the bed plate 17. The operator then manually grasps the carriage cover 33 and moves it from its forward position to a rearward position, that is from left to right as shown in FIG. 1. When in the position shown in FIG. 1, the projection 54 on the lifting cam lever 53 is located within the slot 48 in the lower track 14 and is biased by the spring 61 so as to be pointing downward. As the operator moves the carriage assembly 20 toward the right, the projection 54 abuts against the rightmost face of the slot 48 and begins to pivot clockwise relative to the axle 52 and against the bias of the spring 61. The pivoting motion, acting through the eccentric arrangement, effects a downward linear motion of the carriage assembly 20. As a result, the platen roller 34 is lowered to create pressure during the imprinting operation.

Figure 5:
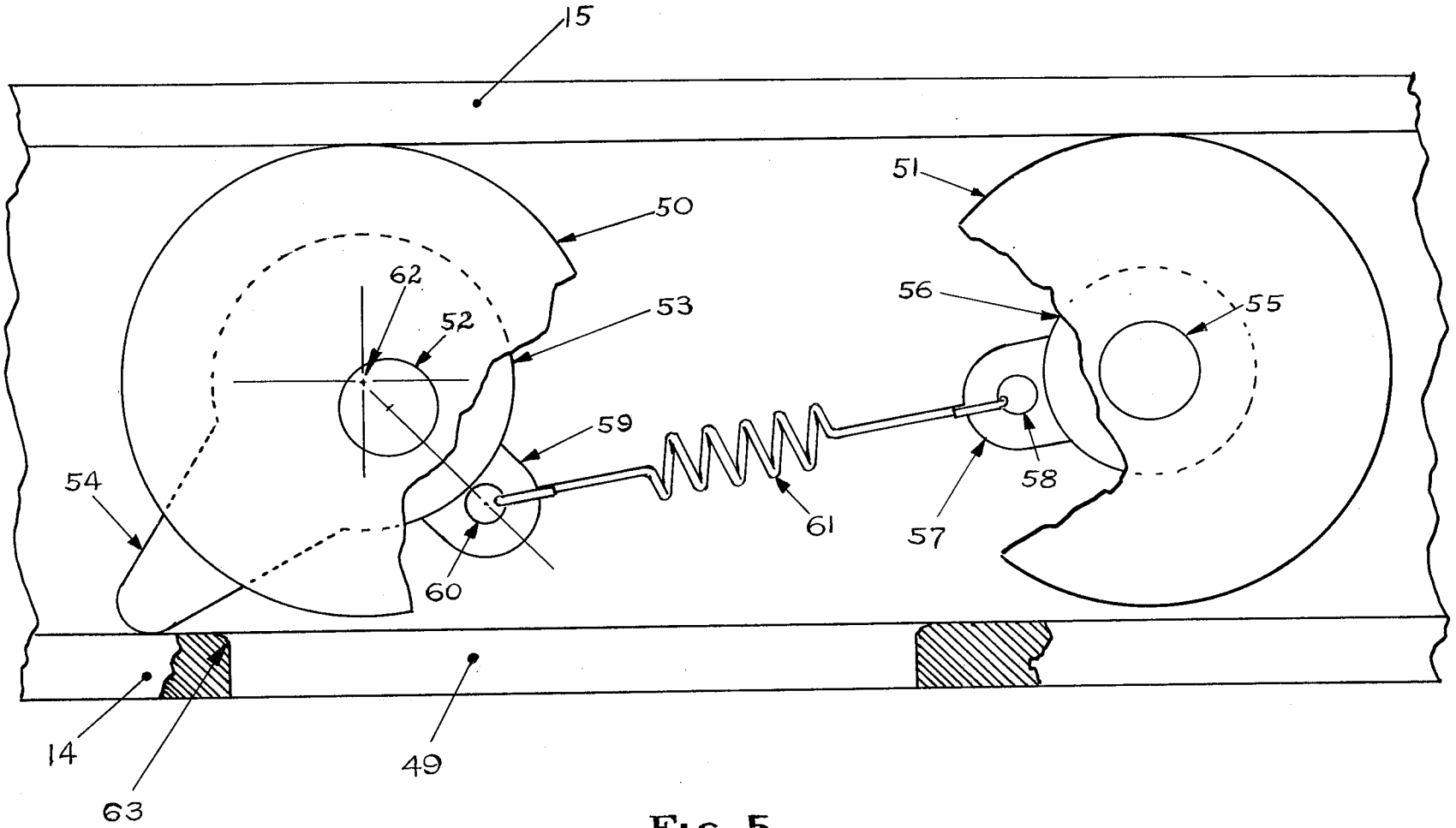
FIG. 5 is an isolated view of the lifting mechanism in accordance with the present invention.

FIG. 5 shows how the projection 54 on the lifting cam lever 53 is disposed as a result of its clockwise rotation as it approaches the end of the imprinting stroke and the beginning of the return stroke. As the carriage assembly 20 reaches the end of the imprinting stroke, the projection 54 will be in registration with the slot 49 and biased thereinto in the counterclockwise direction by the spring 61. It should be first kept in mind that as the carriage assembly was being moved through the imprint stroke or mode and the projection 54 was being moved clockwise against the bias of spring 61, the eccentrically mounted front axle 52 was being caused to experience a downward displacement and thus move the carriage assembly 20 downwardly to effect pressure by the platen roller 34 during the imprint stroke. As the projection 54 is rotated counterclockwise in the slot 49 after the carriage assembly 20 has reached the end of the imprinting stroke, the axle 52 is rotated in a counterclockwise direction about the eccentric axis 62 so as to begin to lift the entire carriage assembly and platen roller 34 from its pressure-exerting position. As the carriage assembly 20 is moved toward the front of the imprinter during the return stroke, the projection 54 rides up upon the abutment 63 which constitutes the front edge of the slot 49 and causes additional rotation of the axle 52 about the eccentric axis 62 to provide further lift to the carriage assembly and platen roller 34 and thereby assure that the platen roller will clear the imprinted sheets and avoid double printing.

While I have shown and described one embodiment in accordance with the present invention, it is clearly to be understood that the same is susceptible of numerous changes and modifications as will be apparent to one of ordinary skill in the art. I, therefore, do not wish to be limited to the details shown and described herein but intend to cover all such changes and modifications as are encompassed by the scope of the appended claims.

I claim:

1. An imprinter for printing data on a document, comprising a base having guidance means; a carriage assembly movable along said guidance means during an imprint stroke and a return stroke; and means cooperating with said carriage assembly and said guidance means for lowering said carriage assembly during the imprint stroke and raising said carriage assembly during the return stroke, wherein said lowering and raising means includes front wheel means engageable at said guidance means and rotatably mounted about a rotatable lifting cam, a front axle eccentrically mounted with respect to said lifting cam and operatively connected with said carriage assembly, a lifting cam lever rotatable in unison with said lifting cam, slot means axially spaced along said guidance means for cooperating with said lifting cam lever at the beginning of the imprint stroke to lower said carriage assembly and at the beginning of the return stroke to raise said carriage assembly, and biasing means for biasing said lifting cam lever into said slot means at the termination of the imprint stroke.

2. An imprinter according to claim 1, wherein rear wheel means are engageable along said guidance means and are associated with said carriage assembly, said biasing means being operatively connected between said rear wheel means and said front wheel means.

3. An imprinter according to claim 2, wherein said rear wheel means includes a rear axle and a collar concentrically mounted about said rear axle and connected with said biasing means.

4. An imprinter according to claim 3, wherein said carriage assembly comprises a first portion having a platen roller rotatably mounted therein, and a second portion vertically adjustable with respect to said first portion and having the front and rear axles operatively connected therewith.

5. A machine for imprinting information on a sheet juxtaposed with a printing plate having raised portions containing the information, comprising a bed plate; C-shaped tracks along the longitudinal edges of said bed plate; a vertical flange extending upwardly from each of said tracks; a carriage assembly having a platen roller movable along said bed plate and guided on each side by said vertical flange; front and rear rollers associated with said carriage assembly and engageable in each of said tracks for only rectilinear movement during imprint and return strokes; and means associated with said front and rear rollers for lowering the carriage assembly during an imprint stroke so that the platen roller can press the sheet against the juxtaposed printing plate and then for raising the carriage assembly during its return stroke so that the platen roller cannot re-press the sheet against the juxtaposed printing plate, wherein said lowering and raising means includes a lifting cam, said front roller being concentrically and rotatably mounted on said lifting cam, a front axle rotatably connected with said carriage assembly being eccentrically mounted in said lifting cam, a lifting cam lever rotatable in unison with said lifting cam, slots axially spaced along each of said tracks such that said lifting cam lever is engaged in one slot at the beginning of the imprint stroke and is engaged in another slot at the beginning of the return stroke, and a spring for biasing said lifting cam lever into said another slot at the termination of the imprint stroke.

6. A machine according to claim 5, wherein said carriage assembly consists of a first portion having the platen roller, and a second portion to which the front and rear axles are mounted, and means for vertically adjusting said second portion relative to said first portion.

* * * * *